United States Patent [19]

Dionne

[11] Patent Number: 4,562,380

[45] Date of Patent: Dec. 31, 1985

[54] TILT-ANGLE ELECTRON GUN

[75] Inventor: Norman J. Dionne, Arlington, Mass.

[73] Assignee: Raytheon Company, Lexington, Mass.

[21] Appl. No.: 504,028

[22] Filed: Jun. 13, 1983

[51] Int. Cl.[4] ..... H01J 25/00

[52] U.S. Cl. ..... 315/4; 315/3.5; 315/5; 315/5.35; 372/2; 313/442

[58] Field of Search ..... 315/3, 4, 5, 3.5, 5.35, 315/39; 372/2; 313/442

[56] References Cited

U.S. PATENT DOCUMENTS 2,812,467 11/1957 Kompfner ..... 315/3.5
4,199,709 4/1980 Alirot ..... 315/5
4,445,070 4/1984 Wachtel ..... 315/5
4,482,843 11/1984 Perring ..... 315/5

*Primary Examiner*—Saxfield Chatmon
*Attorney, Agent, or Firm*—Martin M. Santa; Joseph D. Pannone

[57] ABSTRACT

A tilt-angle electron gun provides a conical beam of electrons for injection into an axially aligned magnetic field of a gyrotron tube. The beam is formed by an electrostatic lens system for focussing and accelerating the electrons within a magnetically shielded region. The conical beam is substantially monoenergetic and laminar so that after injection into the magnetic field the resulting hollow beam has gyrating electrons which have an axial velocity spread sufficiently low for high efficiency gyrotron amplification.

12 Claims, 5 Drawing Figures

TILT-ANGLE ELECTRON GUN

The Government has rights in this invention pursuant to Contract No. N00173-80-C-0261 by the Department of the Navy.

BACKGROUND OF THE INVENTION

The cyclotron resonance maser (or gyrotron) class of device has been demonstrated to be an efficient means for generating r.f. power at millimeter wavelengths without intricate r.f. circuitry. In brief, the principle of operation is that electrons of a hollow monoenergetic beam whose cyclotron frequency is determined by a strong, uniform axial magnetic field interact mainly with the transverse r.f. fields of a traveling wave within a cylindrical waveguide. Power extraction from the electron beam occurs near the waveguide mode dispersion curve intersection with the Doppler shifted cyclotron frequency.

A crucial aspect of the performance characteristics of a gyroamplifier is the quality of the beam formation/-focusing system. The system must successfully deliver a substantially monoenergetic beam (low axial velocity spread for high efficiency) with a high rotational energy component through a long radio frequency interaction zone (25 to 50 cyclotron periods) in a strong magnetic field (0.4 to 1.8T depending upon harmonic). The beam system then must properly distribute both the modulated and unmodulated beam at an externally-cooled collector surface at tolerable power density levels ($<3$ KW/cm$^2$). The radial spatial distribution of the beam should favor location near the field antinodes of the mode of interest in order to selectively minimize interaction with undesired modes. As a practical matter, it is difficult to satisfy all these requirements for a given set of beam parameters.

The most successful method in the prior art for accomplishing a workable compromise among the desired beam parameters has been the so-called "magnetron injection gun" (MIG). While the MIG type gun provides adequate performance for gyrotron oscillators, the gun appears to provide only marginal performance for the much longer interaction lengths required for gyroamplification at high gain. The deficiency of the MIG-type gun has been identified as excessive axial velocity spread which adversely impacts upon electronic efficiency.

The geometries associated with the MIG-type gun provide proper boundary conditions for launching a narrow strip beam. However, there are several complicating restrictions. The current density of practical electron emitters has an upper bound at present of approximately 8 A/cm$^2$. The surface roughness, the initial thermal velocity of the emitted electrons and the space charge of the beam, especially at low velocity, creates significant trajectory distortions which translate into velocity spread in the launched beam. This has necessitated adoption of temperature-limited operation in order to decrease the transit times during beam launch by providing locally high fields at the emitter surface in the order of $10^5$–$10^6$ V/cm.

There have been other attempts to improve the beam formation situation by employing alternative schemes such as field reversals and bifilar focusing of Pierce-type guns operated at high mirror ratios. A formulation of the shielded center-pole gun, employing field reversal, has been described in "Magnetically-Shielded Electron Guns with a Center Magnetic Post," N. R. Vanderplaats, H. E. Brown and S. Ahn, Technical Digest IEDM, pp. 336–338, Wash. (1981).

Electron beams suitable for gyrotron type of r.f. interaction require electron guns that differ substantially from those employed in conventional O-type microwave tubes. Because power conversion involves the rotational kinetic power of the gyrobeam, beam formation for this newer class of devices must generate a transverse-to-axial velocity ratio, $\alpha$, typically between 1.0 and 2.0 for efficient operation. Additionally, in order to provide better performance, it is desirable for the longitudinal velocity spread to be kept small (less than 20% for oscillators and less than 5% for amplifiers).

It is therefore an object of this invention to provide a new type of gyrobeam electron gun which meets the abovestated requirements.

It is a further object of this invention to provide a novel beam formation scheme which circumvents most of the limitations associated with the prior magnetically-immersed gun configurations.

It is a feature of this invention that there is a separation of the electrostatic beam formation problem from the magnetic focusing problem.

SUMMARY OF THE INVENTION

These and other objects and features of the invention are provided by the invention by providing an electron gun which forms a conical electron beam within a magnetically shielded region. The electrostatic fields within the magnetically shielded region provide a beam which is substantially laminar in that the electrons in the beam are caused to be traveling in paths which are substantially parallel to one another near the exit region of the magnetically shielded region. The laminar beam is injected into a substantially external magnetic field. The angle of injection, typically 45°, provides an electron beam having substantially equal velocities in the axial direction of the external magnetic field and in the direction transverse to the axis of symmetry of the external magnetic field. The external magnetic field is substantially of uniform flux density in a region outside the shielded region, but extends into the output aperture of the shielded region in a controlled manner to provide flux focussing of the electron beam which produces the hollow gyrobeam having the desired small longitudinal velocity spread. However, the external magnetic field beyond the poles may be varied to control the final velocity ration value of $\alpha$.

The advantages of the shielded gun approach of this invention are significant. First, formation of a conical beam outside the magnetic field region provides relief from the emitter current density limitations inherent in the immersed field approach represented by the MIG-type gun. Second, separation of the electrostatic beam formation from the magnetic focussing of the beam permits space-charge-limited operation with virtually no penalty in the velocity spread properties. Third, as a consequence of the space-charged limited operation, the noise figure of an amplifier employing the gun of this invention has an appreciably lower value relative to the MIG-type gun because of the space-charged smoothing of the fluctuation currents. Fourth, the space available in the shielded region permits nonintercepting grid control of the electron beam. Fifth, a fairly large (20° to 45°) beam injection angle into the magnetic field produces an initial transverse velocity to axial velocity ratio which reduces the required level of magnetic compression.

BRIEF DESCRIPTION OF THE DRAWINGS

Other objects and features of this invention are explained in the following description taken in conjunction with the accompanying drawings, wherein.

DESCRIPTION OF THE PREFERRED EMBODIMENT

Figure 1:
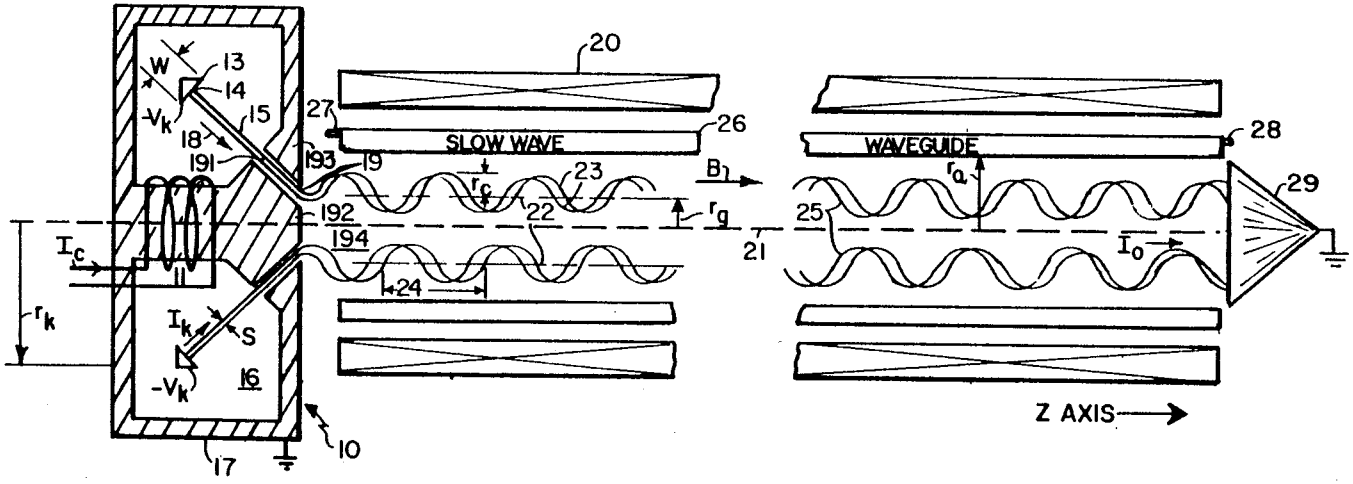
FIG. 1 is a pictorial view of a gyrotron tube including the electron gun of this invention.

Referring now to FIG. 1, there is shown a schematic representation of the conical electron gun 10 where a small driving current $I_c$ through a coaxial trim coil 11 on the center pole 192 functions as a control parameter for the beam radius and its transverse velocity ratio. An emitter 13 having an emitter surface 14 which is a conical strip provides an electron beam 15 in the interior region 16 of the magnetic shield 17. The electrons of the beam 15 are focussed and accelerated in the direction 18 and pass out of the field-free region 16 through an aperture 19 of the magnetic shield 17. There is an external magnetic field B provided by a solenoid 20 which may be of the superconducting type external to the magnetic shield 17. The flux density B is of a magnitude which is below the saturation point of the magnetic shield 17 which results in the field interior to the shield 17 being substantially zero. A well-formed laminar-flow beam 15 is accelerated by electrostatic fields to full voltage from the emitter heated to a temperature sufficient for space-charge-limited operation. In passing through the conically shaped channel 191, the beam 15 is free of the accelerating electrostatic fields, and enters into the magnetic focusing fields within channel 191 determined by the shapes of poles 192, 193.

Because the emitter channel 191 is inclined (tilted) at an angle of approximately 45° with respect to axis 21, the transverse to axial velocity ratio, $\alpha$, of the electrons in beam 15 at the aperture 19 has a value on the order of unity. Thus, the beam injection angle into the magnetic field thus controls the resulting $\alpha$ after magnetic compression by the field B. The magnetic stray-field within the channel 191 near the exit aperture 19 is shaped in order to minimize trajectory aberrations and is the beginning of the magnetic capture zone 194. The beam 15 is injected at a velocity $v_a$ in the direction of the axis 21 and at a velocity $v_t$ in a direction transverse to the axis 21. As a result, each electron of the beam 15 under the influence of the external field B undergoes rotation about an axis 22 and is also translated along the direction of the axis 22 to form a hollow beam centered about the axis 21. This results in a wall of electrons, each rotating at a radius $r_c$ about an axis 22 which is parallel to central axis 21. The radius $r_g$ of the surface in which the axes 22 lie is primarily determined by the means radius of the orifice 19 at the point at which the electrons emerge from orifice 19. The cyclotron radius $r_c$ of each electron is determined by the transverse velocity $v_t$ and the magnetic field B. The electron trajectories 23 have a Larmor length 24 which is dependent upon the magnitude of the transverse velocity $v_t$ of the beam 15, the magnitude of the external magnetic field B, and the axial velocity $v_a$ of the electron beam 15. A slow wave waveguide 26 surrounds the gyrating-electron hollow beam 25 and couples energy into and from the electron beam into the waveguide 26. A high frequency signal provided to the input port 27 of waveguide 26 is thereby amplified and is provided to a load coupled to an output port 28. The hollow beam 25 proceeds alongside waveguide 26 until the beam is terminated by striking a collector 29 where the energy of the beam is dissipated as heat. It should be understood that the structure shown in FIG. 1 is contained within a vacuum structure (not shown) except for the source 20 of magnetic field B and the waveguide 26 which may be external to the vacuum. Table 1 provides illustrative values for a strucutre such as that shown in FIG. 1.

TABLE 1

| | | |
|---|---|---|
| beam voltage, $V_K$ | 33K | V |
| beam current, $I_0$ | 1 | ampere |
| emitter current density, $J_{max}$ | 2 | A/cm$^2$ |
| waveguide radius, $r_a$ | 2.745 | mm |
| velocity ratio, $v_t/v_z$ (after magnetic compression) | 1.5 | |
| cyclotron radius, $r_c$ | 0.4245 | mm |
| magnetic field, B | 1.22 | T |

It is convenient to partition the gyrating-beam formation into two distinct parts to separate the electrostatic beam launch from the magnetic-focusing in forming the electron beam. First, the electrostatic portion of beam formation (low magnetic field zone) is considered in order to establish the electrode shapes and voltages which will yield the proper current, size, and laminarity characteristics. Following this step, the beam formation from the interior of the anode drift channel 191 into the magnetic field zone is considered. This permits determination of the proper magnetic field shapes in the nonadiabatic transition zone of region 194 which will achieve the desired low velocity spread-levels.

A primary feature of the tilt-angle gun 10 is that its conical beam is injected into the magnetic capture zone at a large angle (around 45°), providing an initial velocity ratio $\alpha$ value of nearly unit ($\alpha = v_t/v_z$). To obtain different $\alpha$ guiding center radius $r_g$ for the same injected beam, the details of magnetic pole configuration in the magnetic capture region 194 need only be changed. Also, the large insertion angle affords more space for the gun electrodes and for voltage hold-off. Because the emitter is located at a large radius value $r_k$ relative to the final guiding center radius $r_g$, the cathode current density can be maintained at more conservative levels than would be possible for the corresponding MIG-type gun. This fact allows use of a correspondingly narrow emitter strip width W and hence a narrower beam 15 of width S is possible. The radius $r_g$ of the gyrating-beam 25 and its cyclotron radius $r_c$ are determined by the radius of the exit aperture 19, the beam voltage $V_K$, and the average magnitude of the flux density B in the vicinity of the region 194 of injection. While beam entry into the magnetic field is nonadiabatic (requiring ray tracing), the passage of the captured beam beyond this zone is adiabatic, in which the following adiabatic relationship results:

$$\gamma v_t^2 = k_1 \quad (1)$$

and assuming neglible electrostatic fields $$v_t^2 + v_z^2 = k_2 \quad (2)$$

From the adiabatic relation (1), the transverse velocity spread is an invariant. The axial velocity spread is found using Equation (2) to be proportional to the transverse velocity spread and to the square of the $\alpha$ value:

$$\Delta v_z/v_z = \alpha^2(\Delta v_{t0}/v_{t0}) \quad (3)$$

where the subscript zero denotes the initial insertion value into the field B. It can be seen from Equation (3) that the gun 10 has potentially low axial velocity spread if the transverse velocity spread can be kept small by generating a monoenergetic laminar flow beam within the conical channel 191.

Figure 2:
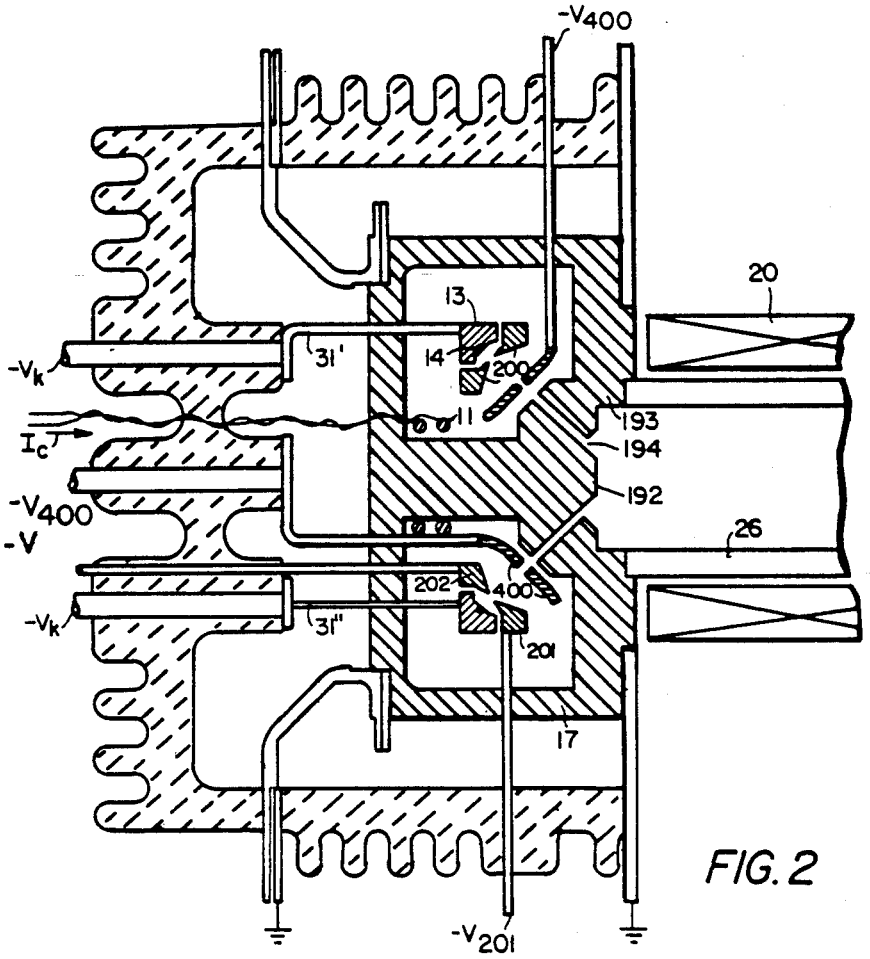
FIG. 2 is a cross-sectional view of an embodiment of the tilt-angle gun of this invention.

Referring now to FIG. 2, the gun design shown includes a modulating anode 200 for control of the beam current level while maintaining constancy of the beam velocity in the rf interaction zone. Anode 200 provides for non-intercepting, low energy (2 KV) grid switching for pulsed application. In addition, anode 200 shortens the physical dimensions for electrostatic focussing without compromising the space needed for a center magnetic pole 192 while permitting adequate clearance for the radial pole piece 193 at high angles of beam inclination. Since an important objective is to obtain low axial velocity spread $\Delta v_z$, use of a modulating-grid anode 200 electrode system provides an advantage in this regard in at least three ways.

First, the transit time of the beam to the magnetic capture zone 194 is significantly reduced because the region governed by the Child-Langmuir potential is foreshortened and is followed by a strong, high-field electrostatic lens. The adverse contribution of the thermal velocities of emitted electrons to beam broadening and to velocity spread is thereby kept to a minimum.

Second, the strong electrostatic lens formed by the interspace between the first modulating anode or grid 200 and the anode 17 (at ground potential) has a focal length which is short compared with the anode channel 191 terminating at the magnetic capture zone 194. The lens action provides compensation for the normal lateral beam expansion stemming from space-charge forces.

Third, by electrically separating the two halves 201, 202 of the nonintercepting modulating grid 200 focusing electrodes, it becomes expedient to bias the potential difference ($V_{201}$–$V_{202}$) a few percent between them in order to provide electro-optical adjustment for any mechanical tolerance related nonconformities in the emitter electrode 13 dimensional location for centering the conical beam down the anode channel 191 space. This capability for correcting the angle of beam entrance into the magnetic focusing region is important not only for attaining high beam transmission but also for fine tuning the axial velocity spread characteristics in a functional gun system.

Figure 3:
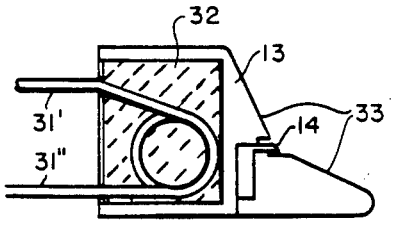
FIG. 3 is a more detailed cross-sectional view of the emitter structure of FIG. 2.

FIG. 3 shows in more detail the emitter structure 13 of FIG. 2 which employed an emitter trapping configuration to permit efficient heat transfer from a heater 31 in a potting material 32 to an impregnated tungsten emitter ring 14. The emitter electrode 13 surfaces 33 provide the desired electrostatic field pattern for beam focussing.

As an example of a gun at a 43° angle using a modulating anode 200 at −10.4 KV (anode 400 not present) and an emitter cathode 13 at −25 KV, the axial and transverse velocity spread (current weighted) for this example is 1.2% and 1.4%, respectively, with the injection $\alpha=0.925$. Thus, in this example (having a severe angular spread because of the modulating-grid 200 to body 17 electrostatic lens action), the axial velocity spread would be less than 6% at an $\alpha=2$ (after magnetic compression). This example illustrates how thermal velocities of the emitted electron are not an important factor in the ultimate velocity spread of the tilt-angle type gun 10 of this invention.

Referring again to FIG. 2, a second modulating anode 400 at an intermediate potential acts like a mild electrostatic lens (always converging). This fact can be exploited by using anode 400 in conjunction with the grid electrodes 200 which also have a mild lens action. The latter effect is reduced by downwardly adjusting the grid electrode voltage to −24.2 KV and by deliberately suppressing space charge in order to illustrate the focal length of this control element. The combined action of the dual lens system of anodes 200, 400 is to provide minimal angular distribution (laminar) of the formed beam in the magnetic capture zone 194. In this manner, effectively removed are the finite focal length limitations that are intrinsic to all apertured beam formation systems including the MIG-type gun. Conceptually, the layout of FIG. 2 shows a viable means for a combined grid and dual anode system for generating a laminar beam havng minimal angular distribution.

Design of the electron gun for the gyroamplifier system involves iterations of computer simulations with electrode combinations which offer compromise among velocity spread (<5%), the control grid 200 voltage (<5 KV above $V_k$), the current density loading (<2 A/cm$^2$), and the use of an optical compensating anode 400 as indicated in FIG. 2. The desired objectives are attainable with the following beam parameters: $\Gamma=1.6$ (magnetic compression ratio of $\alpha$), $\alpha=2.0$, $I_k=2.8$ A, $V_k=-25$ KV, $V_{200}=-23.5$ KV, and $V_{400}=-10.4$ KV. At the second harmonic, the beam envelope parameters are $R_{max}=0.542$ cm, $R_{min}=0.457$ cm about a guiding radius $r_g$ of 0.500 cm. The velocity spread in the r.f. interaction space is $\Delta v_t/v_t<1\%$ and $\Delta v_z/v_z<4\%$.

A crucial component in the slow wave, gyroamplification system is the magnetic focusing system. It must be capable of delivering high magnetic fields with provision for tailoring or shaping the magnetic field in both the collector 29 and gun 10 regions while maintaining a virtually ripple-free field of prescribed shape over the r.f. interaction zone. At 35 GHz, the level of magnetic field is approximately 10.3 kG for fundamental operation.

The preceding considerations have indicated several practical advantages to be gained by launching a well-formed conical beam and injecting it into a magnetic focusing field at moderate-to-large angle $\theta_B$. Among these is the obvious reduction in the emitter current-density. For achieving low velocity spread characteristics under these large angle conditions, the shaping of poles 192, 193 is an effective technique.

By employing the so-called flux function treatment of the magnetic fields, use can be made of Busch's theorem (see P. Kirstein, G. Kino, W. Waters, "Space Charge Flow," McGraw-Hill, Inc. (1967)) in order to describe the trajectory behavior in a complicated field distribution. Thereby, detailed sketching of the electron trajectories is possible, once the flux function (or flux lines)

for a given pole configuration is determined. The flux function, w(r,z), is defined as the product of the azimuthal component of the magnetic vector potential $A_\theta$ and the radius value r,z is the coordinate along the axis 21:

$$W = rA_\theta(z).$$

W is the total magnetic flux within radius, r, divided by $2\pi$.

The most convenient use of the flux function occurs in conjunction with Busch's theorem expressing the electron angular velocity about the axis of symmetry:

$$\dot{\theta} = [\gamma_o r^2{}_o\theta_o + \eta_o(W - W_o)]/\gamma r^2 \quad (4)$$

where the subscript zero refers to the values at any given coordinate ($r_o$, $z_o$). Equation (4) is valid only for axially-symmetric systems where $\eta_o$=electronic charge-to-rest mass ratio, $\gamma = 1 + \eta_o V/c^2$ where V=electrostatic potential distribution, c=velocity of light ($\gamma$=relativistic mass correction factor), r=instantaneous radius of electron measured from axis 21, the time derivative is indicated by the conventional dot.

It is useful to choose the reference point at the emitter where the initial azimuthal velocity $v_t$ of the electrons is negligibly small. Equation (4) is a valuable tool for accomplishing the numerical trajectory calculations as well as a useful guide for gleaning insight into the velocity spread behavior anticipated for the electron gun of this invention.

Figure 4:
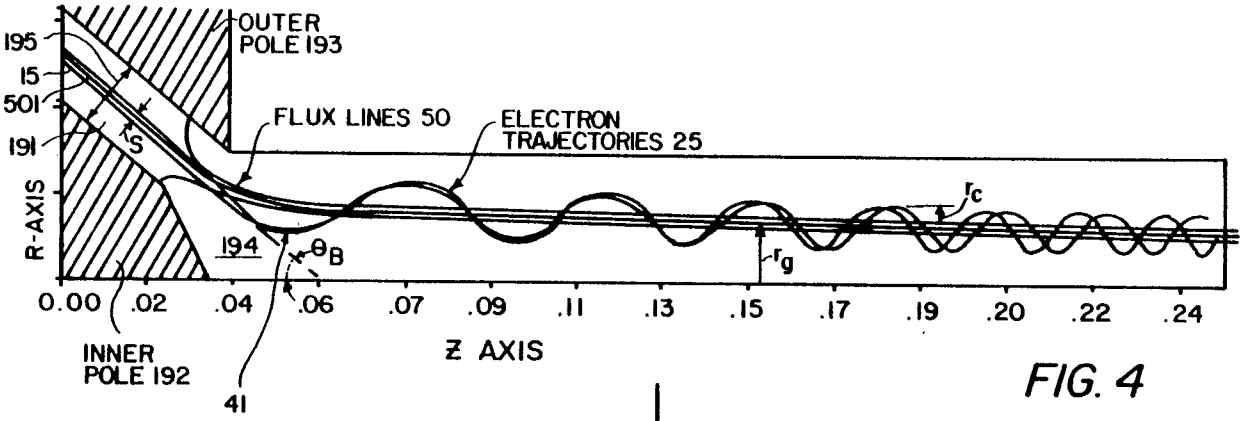
FIG. 4 is a plot of flux lines and electron trajectories along a partial longitudinal cross-sectional view along the gyrotron tube.

The flux-focused approach to gyrobeam formation from the magnetically-shielded, center-post, tilt-angle type of this invention consists of individual electron trajectories remaining in contact at discrete points along flux lines connecting the point of emission at the cathode emitter. In FIG. 4, computed electron trajectories 25 of beam 15 are seen to follow the flux lines 50 in the pole gap 195 into the magnetic capture zone 194 whereupon the flux lines rapidly increase in density and emerge from both inner 192 and outer 193 poles in a manner which permits the flux lines 501 linking the emitter to pass smoothly through the pole gap. With pole materials designed to operate well below their saturation magnetization levels, the average flux density in the interior region of the channel 191 is very small. Consequently, the trajectories are launched within a virtually uniform (but nonzero) region of flux function since the flux is carried by the center pole 192 and not the aperture 19 enclosed by the pole elements 192, 193.

To illustrate the focusing mechanism, the dynamical equations of the previous paragraphs are adapted to the region where the electrostatic field is negligible. Under the reasonable assumption that the initial angular velocity at the emitter is negligible, Equation (4), the electron angular velocity $\theta$ about the axis of symmetry 21, becomes:

$$\dot{\theta} = \eta_o(W - W_o)/\gamma r^2 \quad (5)$$

Similarly, under the electrostatic-field-free assumption, the radial and axial acceleration equations are given by:

$$= r\dot{\theta}^2 - \eta_o\dot{\theta}W_r/\gamma \quad (6)$$

$$= -(\eta_o/r\gamma)^2(W - W_o)W_z \quad (7)$$

A subscript other than zero denotes the partial derivative of the scalar function. From these three relationships, it is clear that the electron experiences no axial acceleration and has no angular velocity wherever its trajectory follows or crosses the flux function value $W_o$ with which it is launched at the emitter 14. These points are designated as equilibrium points. It is important to realize that, for a well-shielded emitter, all trajectories are launched at very nearly the same initial flux function value, $W_o$, and, therefore will have equilibrium points along the same flux line.

Equation (7) has important consequences in the formation of a gyrobeam with low axial velocity spread. By assumption, the beam is a drifting mono-energetic beam, having a constant velocity magnitude. By shaping the magnetic poles to provide the proper flux function distribution, the axial acceleration can be maintained at a slightly positive, or nearly zero, value during magnetic injection. This means that the initial radial velocity can be converted into azimuthal velocity at no loss to the axial velocity.

Computed electron trajectories 25 and flux function lines 50 are shown in FIG. 4. Inside the pole gap 195 of channel 191, only minor magnetic forces are experienced. However, in the magnetic capture zone 194, the flux function lines linking the tapered center pole 192 are nearly parallel to the axis. Moreover, as the flux differential quantity, $W - W_o$, approaches its peak negative value at the first radial minimum point along the trajectory 41, the axial derivative, $W_z$, nearly vanishes. The combined effect of these two factors is to sustain a nearly constant axial velocity during magnetic injection. If the axial distance over which the flux lines become parallel to the axis is made short (ideally one-half) compared with the Larmor drift length 24 (axial distance traveled by an electron during one orbit), the velocity spread contribution arising from the magnetic injection can be made insignificant. Thus, the injection radial velocity forms the basis for the transverse velocity in the case of the flux-focused approach to gyrobeam formation, when proper attention to pole shaping is given. Also, the initial transverse velocity to axial velocity ratio can be controlled either by pole geometry or by means of a coaxial trim coil 11 which shifts the value, $W_o$, at the emitter (which is essentially the flux through the center pole 192).

Figure 5:
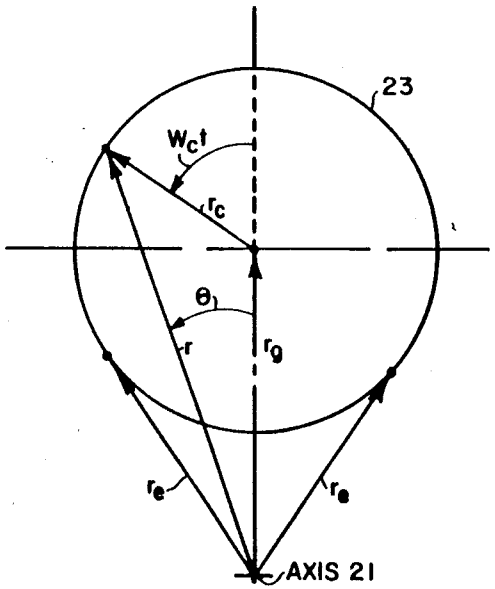
FIG. 5 is a view of an electron trajectory in the direction of the tube axis.

Once the conical beam has been injected into the magnetic field and individual electrons have undergone a single orbit the magnetic field B is nearly uniform over the beam cross-section at any given axial plane. Under these conditions, the individual electrons may be viewed as having an instantaneous circular orbit, having a guiding center radius, $r_g$, relative to the axis of symmetry 21. As can be seen in FIG. 5, an electron rotates about the guiding center $r_g$ with the cyclotron frequency $\omega_c$, and at a cyclotron radius, $r_c$. For the axis of symmetry 21, the instantaneous radius, r, can be expressed as a function of time by:

$$r = (r_c^2 + 2r_c r_g \cos \omega_c t + r_g^2)^{\frac{1}{2}} \quad (8)$$

where the initial time is taken when $\theta$ vanishes at the maximum radius value. By geometry, the guiding radius can be obtained from:

$$r_g^2 = r_c^2 + r_e^2.$$

The equilibrium radius, $r_e$, is taken at the points on the orbit for which the flux function equals that at the emitter. To obtain the cyclotron radius, the instantaneous velocity ratio, $\alpha$, is presumed known; and the following relationship is derived:

$$r_c = \alpha c(\gamma^2 - 1)^{\frac{1}{2}}/(\alpha^2 + 1)^{\frac{1}{2}}\eta_o B_z.$$

Flux contours and trajectory computation are indispensible to these evaluations. A good estimate for the initial velocity ratio, using the flux-focused approach depicted in FIG. 4, is:

$$\alpha_o = \tan \theta_B$$

where $\theta_B$ is the half angle of the cone of the injected conical beam.

Generation of a gyrobeam having a prescribed guiding radius and transverse velocity ratio $\alpha$ is seen to result naturally from the details of the flux lines in the flux-focused approach. Basic to this method of beam injection is the flux linkage from the emitter through the pole gap. The pole geometries and/or the flux passing through the center pole 192 via a small coaxial coil 11 can be adjusted to obtain the desired flux linkage and to provide beam parameter control.

Injection of a well-formed conical beam can be performed smoothly with minimal velocity spread with the flux-focused method of this invention, provided care is taken to shape the flux lines (as in FIG. 4) in the region of the first orbit. The integral of Equation (7) can be made small compared to the axial velocity $v_z$ if $W_z$ can be made small as $(W - W_o)$ approaches its peak values.

While flux-focused injection fosters favorable, initial levels of the transverse velocity ratio $\alpha_0$, it is also well-posed toward the attainment of low velocity spread for the following reason. The beam in the pole gap has only a slight angular spread arising from (a) the thermal velocity spread at the emitter, (b) the electrostatic aberration of the electrode system, and (c) the space charge expansion forces which become more significant at the smaller radius values of the conical beam. This angular spread is partially compensated by a slight magnetic lens action which tends to compress the beam. The flux differential factor, $W - W_o$, of Equation (7) undergoes a change of sign with radius at the axial plane where the conical beam of finite width, s, emerges from the pole gap. Trajectories at the outer part of the conical beam experience greater deceleration (or lesser acceleration) than do trajectories that are more interior of the beam. Thus, depending upon the beam current level, the magnetic lens action is adjusted to minimize the angular spread (typically less than 1° of arc before compensation).

A feature which may be incorporated into an electron gun design is a provision for making the center magnetic pole removable from the vacuum envelope in order to permit "optimized" pole shapes for different levels of current operaion. On the other hand, use of the small coaxial 11 coil is an alternative in trimming the magnetic flux shapes for this purpose.

In view of the preferred use of a superconducting solenoid for the magnetic focusing system, it is practical to design the magnet flux shield (linking the radial pole 193 to the center magnetic pole 192) as a mechanically removable item, external to the vacuum envelope. This would facilitate gun-assembly insertion into a focusing solenoid of limited bore size. Once the tube assembly has been placed within the solenoid, it would be simple to make the requisite mechanical attachment. This approach would readily permit enclosure of a removable external solenoid to be used for field adjustment in the beam formation.

In summary, the tilt-angle-type gun has salient advantages over prior art MIG-type, immersed emitter guns. First, there is space-charge-limited operation which translates into lower noise figure and more stable operation. Because the virtual cathode physically locates itself above the emitter, there is no contribution from surface roughness. Second, because the emitter is steeply inclined, the cathode current-density can be reduced by increasing the physical dimensions. Thus, beam dimensions are mostly independent of the emitter radius. Third, because of the large angle of inclination, the beam is inserted into the magnetic field at nearly the final values of $\alpha$. Fourth, because the electrostatic problem is separated from the magnetostatic one, the beam formation can be expedited by field-shaping electrodes which can accommodate the high space charge near the cathode without incurring velocity spread problems. Therefore, the axial velocity spread can be kept below 5% at $\alpha$ values in the useful range of approximately 1.5 to 2.0.

Having described a preferred embodiment of the invention, it will now be apparent to one of skill in the art that other embodiments incorporating its concept may be used. It is felt, therefore, that this invention should not be restricted to the disclosed embodiment, but rather should be limited only by the spirit and scope of the appended claims.

What is claimed is:

1. An electron gun comprising:

means for providing a conical beam of electrons having an axis of symmetry;

said means for providing a conical beam of electrons comprising an emitter, said emitter being within means for magnetically shielding;

means for providing a magnetic field along said axis of symmetry external to said shielding means;

means for magnetically shielding said beam;

said means for magnetically shielding being symmetrical with respect to said axis of symmetry and external to said magnetic field providing means;

means for focusing said electron beam within said shielding means;

said shielding means having an opening for allowing said conical beam of electrons to exit said shielding means after said beam has been focused by said focusing means;

said opening of said magnetically shielding means being within the flux external to said magnetic field providing means;

the flux density in said shielding means being below the saturation value of said shielding means to provide a magnetic flux free region at said emitter within said shielding means;

said shielding means having an inner pole extending along and symmetrical with respect to said axis;

said shielding means having a radially directed outer pole transverse to said axis and symmetrical with respect to said axis;

said inner and outer poles being separated by a space concentric with said axis to form said opening, said space forming a conical channel between said poles; and said beam of electrons exiting said shielding means through said conical channel.

2. The electron gun of claim 1 wherein the half-angle of the cone of the conical beam is greater than twenty degrees.

3. The electron gun of claim 1 wherein said beam of electrons is a laminar, mono-energetic beam.

4. The electron gun of claim 1 wherein said inner and outer poles have exterior faces terminating said channel where said conical beam exits said shield, said faces being tapered to lie in conical surfaces symmetrical about said axis to alter a magnetic field into which said conical electron beam exits.

5. The electron gun of claim 1 wherein:

said means for producing a conical beam of electrons comprises a circular ring emitter concentric with and transverse to said axis;

said shielding means having a conical channel of uniform width terminating at said opening, said opening being circular and symmetrical about said axis;

said circular emitter lying in the conical surface formed by extension of said concical channel.

6. The electron gun of claim 1 wherein:

said focusing means comprises a modulating grid electrode; and means for biasing said grid electrode with respect to said emitter to provide an electron space charge between said grid electrode and said emitter.

7. The electron gun of claim 1 wherein said emitter lies on a conical surface transverse to said conical beam of electrons.

8. An electron gun comprising:

an emitter in the form of a ring providing a conical beam having an axis of symmetry transverse to said ring;

a magnetic shield surrounding said emitter and symmetrical with respect to said axis;

said shield having an inner and an outer pole separated by a conical channel;

said conical channel having an axis of symmetry coincident with the axis of symmetry of said emitter;

means for applying a potential difference between said shield and said emitter to provide a conical beam of electrons which exits said shield through said channel;

said beam being directed substantially parallel to said channel;

means for providing a magnetic field external to said shield symmetric with said axis of symmetry;

said channel of said shield being immersed in an external magnetic field;

said inner and outer poles of said shield having a higher saturation flux density than the flux density provided in said poles by said external magnetic field;

said emitter within said shield having substantially no flux density within it;

said external magnetic field fringing into said channel being substantially parallel to said beam within said channel; and said external magnetic field between said shield and said magnetic field means following a smooth trajectory between the beam direction within said channel and said axis of symmetry.

9. The electron gun of claim 8 comprising a control grid intermediate said shield and said emitter means for applying a voltage to said grid to control the magnitude of the electron beam current.

10. The electron gun of claim 9 wherein said control grid comprises several rings, each ring symmetrical with respect to said axis, the space between said second and third rings being sufficiently large to allow said conical electron beam to pass therethrough;

means for providing a potential difference between said first and second modulating grids.

11. The electron gun of claim 9 comprising:

a focusing anode intermediate said shield and said control grid, said focusing anode being symmetric with respect to said axis, said focusing anode being formed by two circular fourth and fifth spaced rings, each symmetric with respect to axis, the space between said fourth and fifth rings being sufficiently large to allow said conical electron beam to pass therethrough.

12. A gyrotron electron tube comprising:

an electron gun having an axis of symmetry for producing a conical beam of electrons;

a symmetrical slow waveguide having an axis of symmetry coincident with said electron gun axis of symmetry;

a solenoid for producing a magnetic field along said axis of symmetry, said field having a radial component in the region adjacent said electron gun;

said electron gun comprising magnetic pole pieces in said magnetic field region;

said pole pieces being shaped to provide a magnetic flux distribution which maintains the axial acceleration of said electrons at a value which is near zoer and slightly positive in the axial direction;

said electron gun comprising:

an emitter in the form of a ring having an axis of symmetry transverse to said ring;

a magnetic shield surmounting said emitter and symmetrical with respect to said axis;

said shield having an inner and an outer pole separated by a conical channel;

said conical channel having an axis of symmetry coincident with the axis of symmetry of said emitter;

means for applying a potential difference between said shield and said emitter to provide a conical beam of electrons which exits said shield through said channel;

said field within said shield being in said inner and outer poles with substantially no field within said channel and at said emitter;

said shield having a saturation flux density substantially higher than the flux density produced by said field within said shield;

said beam of electrons being subject to a magnetic field within said channel which is substantially parallel to said beam;

said magnetic field between said pole pieces and said solenoid bending from a direction parallel to said channel to a direction parallel to said axis.

* * * * *